US007903070B2

(12) United States Patent
Moon et al.

(10) Patent No.: US 7,903,070 B2
(45) Date of Patent: Mar. 8, 2011

(54) APPARATUS AND METHOD FOR DRIVING LIQUID CRYSTAL DISPLAY DEVICE

(75) Inventors: Su Hwan Moon, Gyeongsangbuk-do (KR); Tae Hwan Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 821 days.

(21) Appl. No.: 11/640,901

(22) Filed: Dec. 19, 2006

(65) Prior Publication Data

US 2008/0001893 A1 Jan. 3, 2008

(30) Foreign Application Priority Data

Jun. 30, 2006 (KR) ..... 10-2006-0060424

(51) Int. Cl.
*G09G 3/36* (2006.01)

(52) U.S. Cl. ..... 345/98; 345/94

(58) Field of Classification Search ..... 345/94, 345/98

See application file for complete search history.

(56) References Cited

U.S. PATENT DOCUMENTS

| | | | | |
|---|---|---|---|---|
| 6,417,829 | B1 | 7/2002 | Jung et al. | |
| 2003/0038766 | A1 * | 2/2003 | Lee et al. | 345/87 |
| 2004/0257322 | A1 * | 12/2004 | Moon | 345/87 |
| 2006/0007215 | A1 * | 1/2006 | Tobita et al. | 345/204 |
| 2006/0038765 | A1 | 2/2006 | Lee et al. | |

FOREIGN PATENT DOCUMENTS

| | | | |
|---|---|---|---|
| DE | 197 23 204 | A1 | 12/1997 |
| KR | 10-2006-0044119 | A | 5/2006 |

OTHER PUBLICATIONS

Office Action, along with its English-language translation, issued in corresponding German Application No. 10 2006 055 328.4-32.

* cited by examiner

*Primary Examiner* — Amr Awad
*Assistant Examiner* — Randal Willis
(74) *Attorney, Agent, or Firm* — Morgan, Lewis & Bockius LLP

(57) ABSTRACT

An apparatus for driving a liquid crystal display device comprises a display area which includes a plurality of liquid crystal cells in portions defined by a plurality of gate and data lines; a gate driver which supplies overlapped gate pulses to the adjacent gate lines; a data driver which supplies a data voltage to the data line in synchronization with the gate pulse; and a timing controller which controls an overlapped section of the gate pulses supplied to the adjacent gate lines.

13 Claims, 7 Drawing Sheets

APPARATUS AND METHOD FOR DRIVING LIQUID CRYSTAL DISPLAY DEVICE

This application claims the benefit of the Korean Patent Application No. 10-2006-60424, filed on Jun. 30, 2006, which is hereby incorporated by reference in its entirety.

BACKGROUND OF THE INVENTION

1. Field of the Invention

The present invention relates to a liquid crystal display (LCD) device, and more particularly, to an apparatus and method for driving an LCD device. Embodiments of the present invention are suitable for a wide scope of applications. In particular, embodiments of the present invention are suitable for driving the LCD device such that a charging property of a pixel is improved.

2. Discussion of the Related Art

Generally, a liquid crystal display (LCD) device uses a thin film transistor (TFT) as a switching element to display images. The LCD device has been widely used in such diverse areas as a personal computer, a notebook computer, and portable devices such as a mobile phone and a calling device, and a photocopy machine.

In the LCD device, gates and data lines cross each other to form pixel regions. A liquid crystal cell is provided in each pixel region. A desired image is displayed by applying a corresponding data signal to the liquid crystal cell. The TFT is formed adjacent to a crossing of the gate and data lines. The TFT switches the data signal to be applied to the liquid crystal cell in response to a gate pulse provided from the gate line.

The related art LCD device has a slow response time because the liquid crystal cell is not discharged fast enough in accordance with the data voltage. Thus, a sufficient video voltage is not supplied to the liquid crystal cell during a turn-on time of the TFT. A pre-charging method has been proposed to compensate the slow response time of the liquid crystal cell. In the pre-charging method, the liquid crystal cell is pre-charged with a prior data by overlapping gate pulses supplied to the adjacent gate lines.

FIG. 1 shows a waveform diagram illustrating a pre-charging method according to the related art. Referring to FIG. 1, gate pulses applied to adjacent gate lines GLi and GLi+1 are overlapped so that a data voltage Vdata is pre-charged in the pixel. For example, the gate pulses supplied to the adjacent gate lines GLi and GLi+1 may be overlapped by a half of a horizontal period.

However, the related art pre-charging method of FIG. 1 is not applicable to a dot or line inversion mode where the polarity of data voltage Vdata changes between vertically adjacent pixels. If the related pre-charging method is applied, the pixel is pre-charged with a data voltage of a first polarity in a pre-charge time, and is then main-charged with a data voltage of a second polarity in a main-charge time. Thus, if a modulation width of the data voltage Vdata increases, the main-charge time increases due to the opposite polarity of the pre-charged voltage. Hence, it is difficult to completely charge the pixel with the correct data voltage. Accordingly, the picture quality deteriorates.

SUMMARY OF THE INVENTION

Accordingly, embodiments of the present invention are directed to an apparatus and a method for driving an LCD device that substantially obviate one or more problems due to limitations and disadvantages of the related art.

An object of the present invention is to provide an apparatus and method for driving an LCD device to improve a charging property of a pixel.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these objects and other advantages and in accordance with the purpose of the invention, as embodied and broadly described herein, an apparatus for driving a liquid crystal display device comprises a display area which includes a plurality of liquid crystal cells in portions defined by a plurality of gate and data lines; a gate driver which supplies overlapped gate pulses to the adjacent gate lines; a data driver which supplies a data voltage to the data line in synchronization with the gate pulse; and a timing controller which controls an overlapped section of the gate pulses supplied to the adjacent gate lines.

In another aspect, an apparatus for driving a liquid crystal display device comprises a display area which includes a plurality of liquid crystal cells in portions defined by a plurality of gate and data lines; a gate driver which supplies gate pulses overlapped by the half of one horizontal period or less to the adjacent gate lines; a data driver which supplies a data voltage to the data line in synchronization with the gate pulse; and a timing controller which controls the gate driver and the data driver.

In another aspect, a method is provided for driving a liquid crystal display device provided with a display area having a plurality of liquid crystal cells formed in portions defined by a plurality of gate and data lines comprises sequentially supplying gate pulses to the gate lines; and supplying a data voltage to the data line in synchronization with the gate pulse, wherein the gate pulses supplied to the adjacent gate lines are overlapped by the half of one horizontal period or less.

In another aspect, a method is provided for driving a liquid crystal display device provided with a display area having a plurality of liquid crystal cells formed in portions defined by a plurality of gate and data lines comprises driving the liquid crystal cells in state of providing a pre-charging period and a main-charging period by overlapping gate pulses supplied to the adjacent gate lines, wherein the pre-charging period is shorter than the main-charging period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
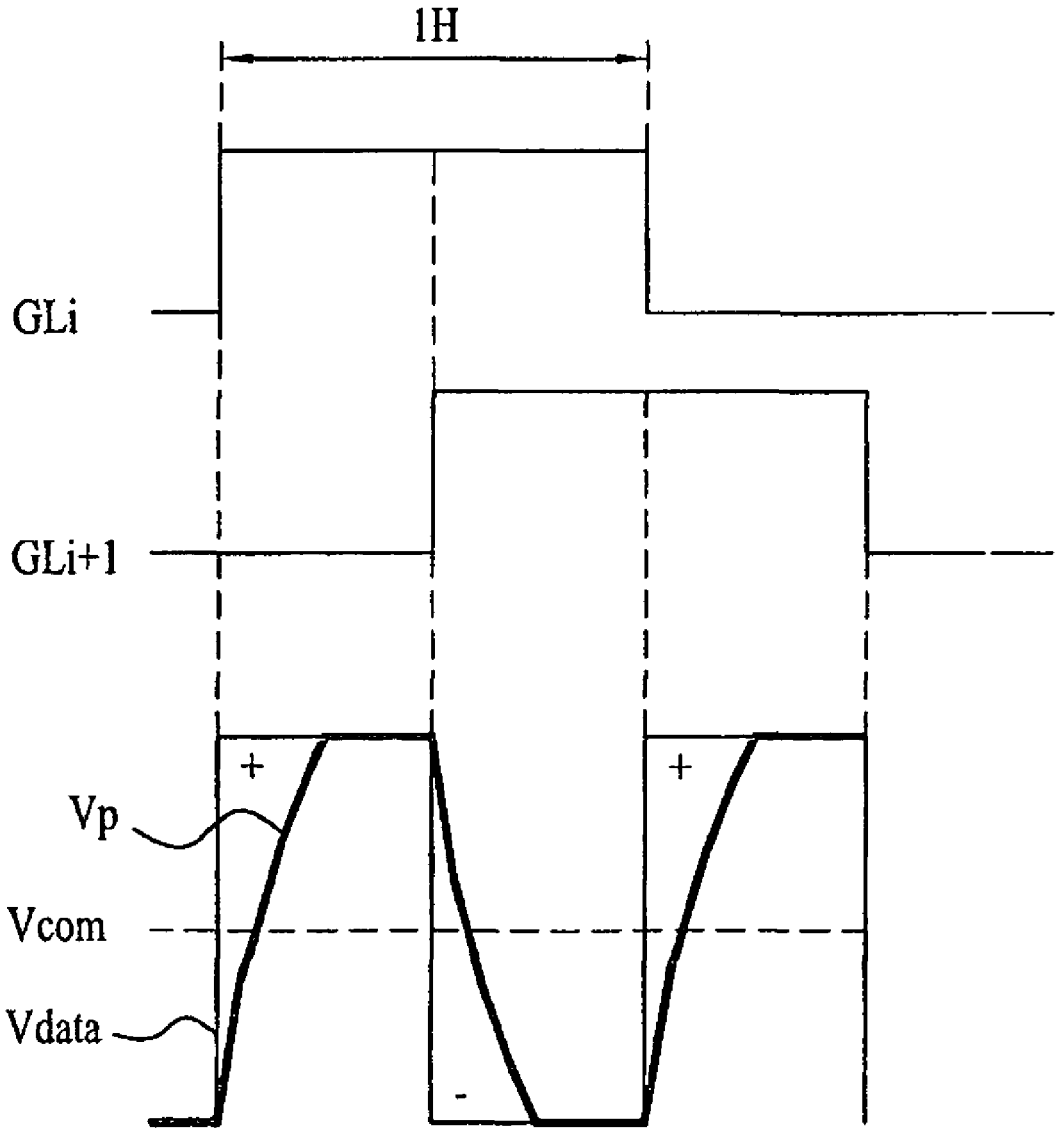
FIG. 1 Related Art
FIG. 1 shows a waveform diagram illustrating a pre-charging method according to the related art.
Figure 2:
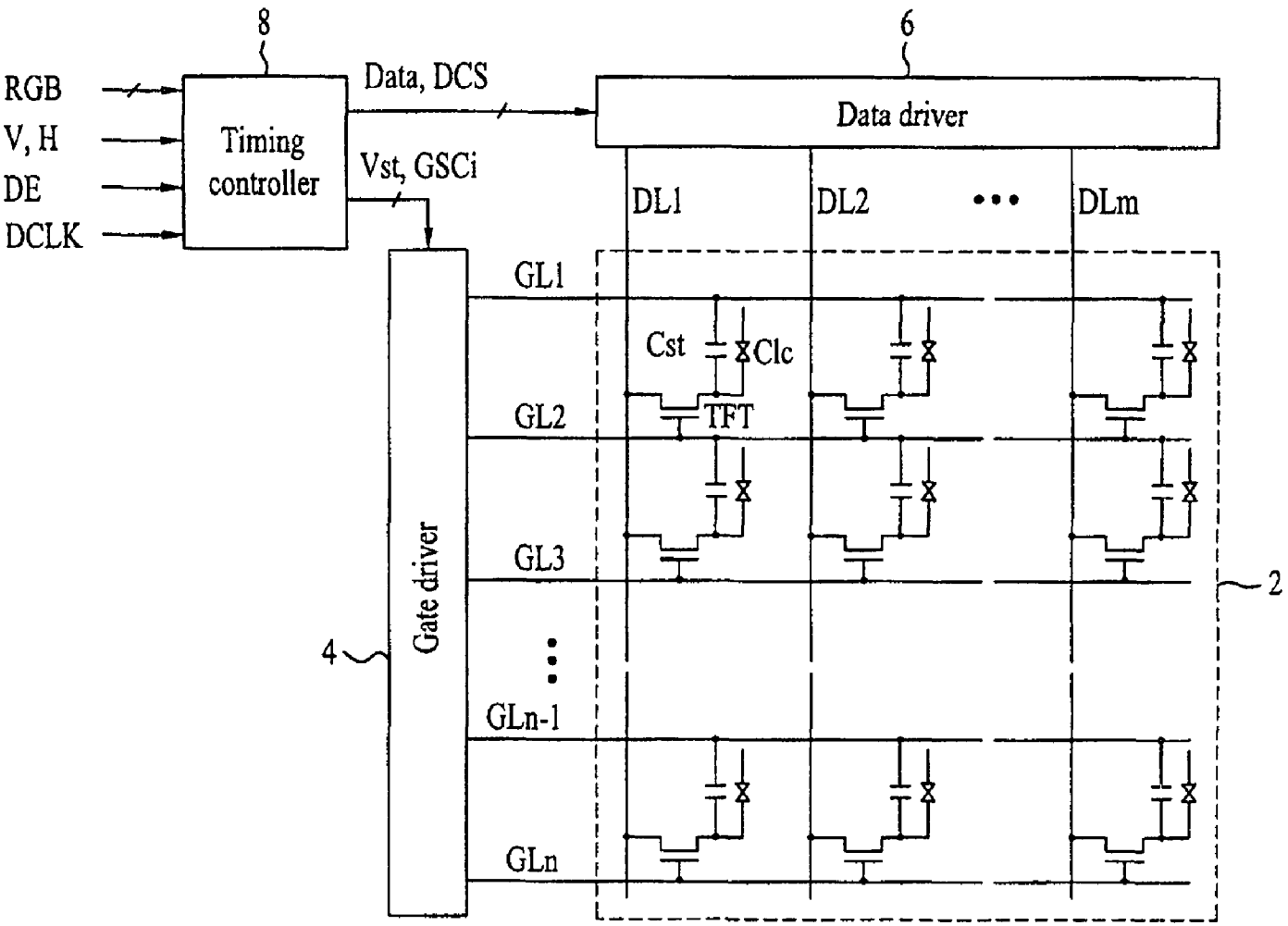
FIG. 2 shows a schematic diagram of an exemplary apparatus for driving an LCD device according to an embodiment of the present invention.

FIG. 2 shows a schematic diagram of an exemplary apparatus for driving an LCD device according to an embodiment of the present invention. Referring to FIG. 2, a display area 2 of an LCD device includes a plurality of gate lines GL1 to GLn crossing a plurality data lines DL1 to DLm to define a plurality of pixel regions; a liquid crystal cell in each of the plurality of pixel regions; a gate driver 4 which supplies overlapped gate pulses to adjacent gate lines, respectively; a data driver which supplies data voltages to the data lines DL1 to DLm in synchronization with the gate pulses, respectively; and a timing controller 8 which controls an overlapped portion of the gate pulses supplied to the adjacent gate lines.

The display area 2 includes a TFT in each of the plurality of the pixel regions. The TFT is connected to the liquid crystal cell in the corresponding pixel region. Each TFT supplies a data voltage provided from one of the data lines DL1 to DLm to the corresponding liquid crystal cell in response to a gate pulse provided from one of the gate lines GL1 to GLn. The liquid crystal cell is connected to the TFT via a common electrode and a pixel electrode. The common electrode faces the pixel electrode with the liquid crystal cell therebetween. Thus, the pixel region may be equivalently represented as a liquid crystal capacitor (Clc). The pixel region also includes a storage capacitor (Cst) to maintain the data voltage charged in the liquid crystal capacitor (Clc) until the next data signal is charged.

The data driver 6 converts data (Data) from the timing controller 8 to a data voltage corresponding to an analog signal in accordance with a data control signal (DCS) provided from the timing controller 8. Also, the data driver 6 supplies a data voltage corresponding to one horizontal line to the data lines (DL) during one horizontal period in response to the gate pulse from the gate line (GL). Then, the data driver 6 inverts the polarity of the data voltage supplied to the data lines (DL) in response to a polarity control signal (POL) provided from the timing controller 8.

The timing controller 8 arranges externally provided input data (RGB) to be appropriate for the driving of the display area 2, and supplies the arranged data to the data driver 6. Also, the timing controller 8 generates the data control signal (DCS) to control the data driver by using vertically and horizontally synchronized signals (V, H), a data enable signal (DE), and an externally provided dot clock signal (DCLK), and simultaneously generates a plurality of gate shift clocks (GSCi) and a gate start signal (Vst) to control the gate driver 4. The data control signal (DCS) includes a source output enable (SOE), a source shift clock (SSC), a source start pulse (SSP), and a polarity control signal (POL). Moreover, the timing controller 8 includes a clock signal generator 10 (shown in FIG. 3) to generate the plurality of gate shift clocks (GSCi).

Figure 3:
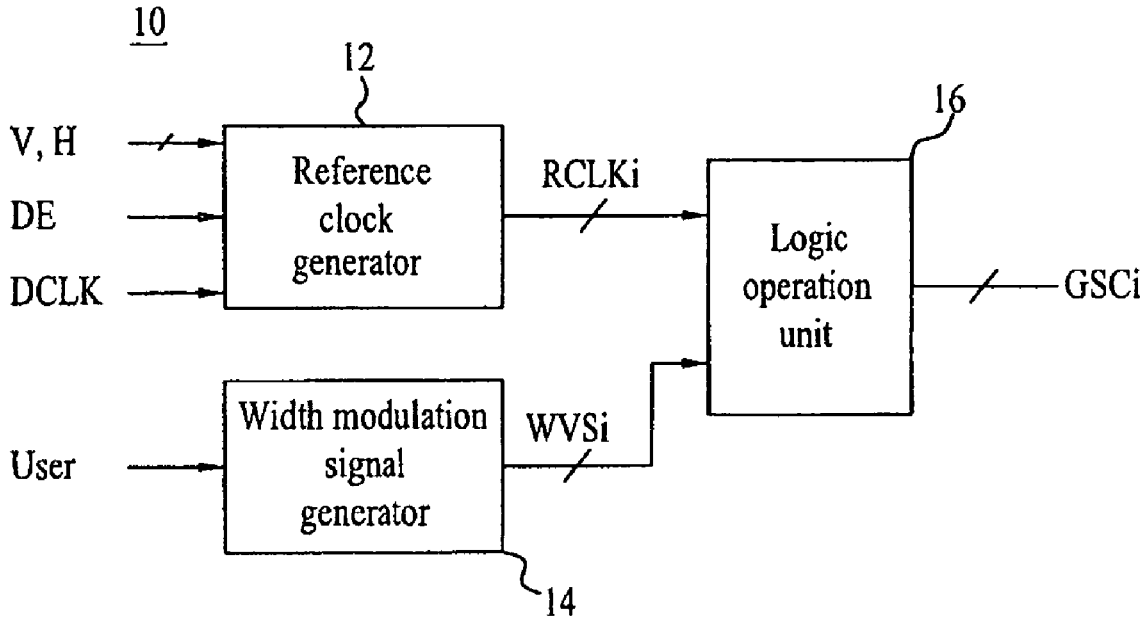
FIG. 3 shows a schematic diagram of a first exemplary clock signal generator according to an embodiment of the present invention.

FIG. 3 shows a schematic diagram of a first exemplary clock signal generator according to an embodiment of the present invention. Referring to FIG. 3, the clock signal generator 10 includes a reference clock generator 12, a width modulation signal generator 14, and a logic operation unit 16. The reference clock generator 12 uses the vertically and horizontally synchronized signals (V, H), the data enable signal (DE), and the dot clock signal (DCLK) to generate a plurality of reference clocks RCLKi sequentially shifted to be overlapped by a half horizontal period.

The width modulation signal generator 14 generates a plurality of width modulation signals (WVSi) corresponding to an initial part (rising time) of one horizontal period, whereby the overlapped portion of the plurality of reference clocks (RCLKi) is smaller than a half horizontal period. The plurality of width modulation signals (WVSi) may have a fixed pulse width. Alternatively, the width modulation signals (WVSi) may have a user-defined pulse width.

The logic operation unit 16 generates the plurality of gate shift clocks (GSCi) by performing a logic operation on each reference clock (RCLKi) generated from the reference clock generator 12 and each width modulation signal (WVSi) generated from the width modulation signal generator 14. The logic operation unit 16 may include a plurality of exclusive-OR (XOR) for performing the logic operation. Thus, the logic operation unit 16 generates the plurality of gate shift clocks (GSCi) by the exclusive-OR operation of each reference clock (RCLKi) with each width modulation signal (WVSi). Accordingly, the plurality of gate shift clocks (GSCi) are sequentially shifted to be overlapped by a half horizontal period or less.

Figure 4:
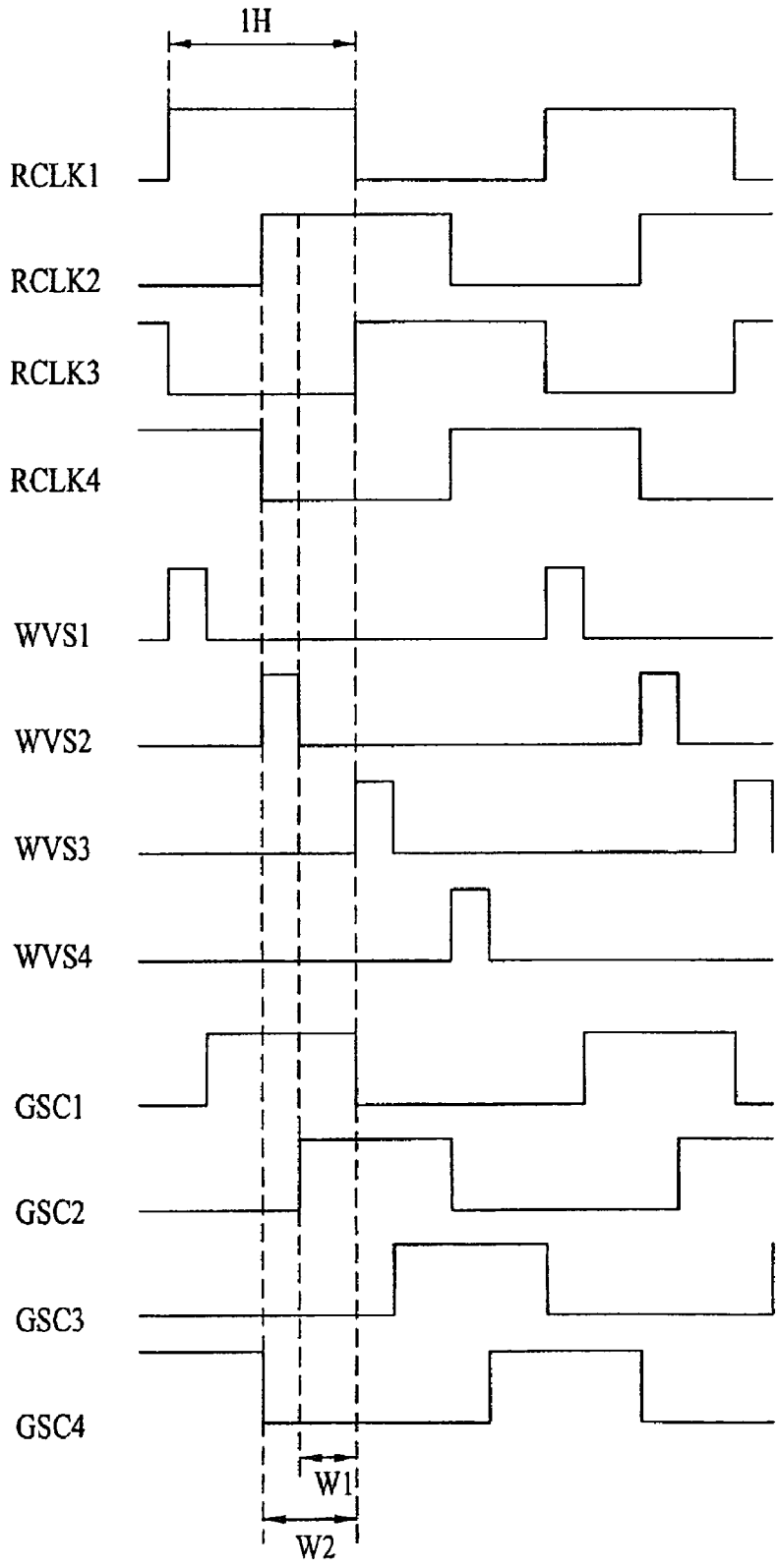
FIG. 4 shows exemplary waveforms for driving the clock signal generator of FIG. 3.

FIG. 4 shows exemplary waveforms for driving the clock signal generator of FIG. 3. Referring to FIG. 4, the clock signal generator 10 generates, for example, four gate shift clocks GSC1 to GSC4. First, the reference clock generator 12 generates first to fourth reference clocks RCLK1 to RCLK4 sequentially shifted with respect to each other to be overlapped by a period W2, for example a half horizontal period or less. Concurrently, the width modulation signal generator 14 generates first to fourth width modulation signals WVS1 to WVS4 sequentially shifted with respect to each other, a rising edge of each of which occurring substantially simultaneously with each of which an initial portion of a corresponding one of the first to fourth reference clocks RCLK1 to RCLK4. For example, the first width modulation signal WVS1 occurs substantially simultaneously with the initial portion of the first reference clock RCLK1; the second width modulation signal WVS2 occurs substantially simultaneously with the initial portion of the second reference clock RCLK2; and so on. The generated first to fourth width modulation signals WVS1 to WVS4 are provided to the logic operation unit 16.

The logic operation unit 16 generates the first to fourth gate shift clocks GSC1 to GSC4 by the exclusive-OR (XOR) operation of each of the reference clocks RCLK1 to RCLK4 with the corresponding one of the width modulation signals WVS1 to WVS4, and supplies the generated first to fourth gate shift clocks GSC1 to GSC4 to the gate driver 4. Accordingly, the overlapped portion W1 of the first to fourth gate shift clocks GSC1 to GSC4 with respect to each other is smaller than W2, which is a half horizontal period or less, for example. Also, the overlapped portion W1 of the first to fourth gate shift clocks GSC1 to GSC4 corresponds to the section obtained by subtracting the pulse width of the width modulation signal WVS1 to WVS4 from the period W2. Based on the pulse width of the width modulation signal WVS1 to WVS4, the overlapped portion W1 of the first to fourth gate shift clocks GSC1 to GSC4 is controlled to be less than W2.

Referring back to FIG. 2, the gate driver 4 includes a shift register which is driven by the gate start signal Vst from the timing controller 8, and sequentially generates the gate pulses according to the plurality of gate shift clocks GSCi. The gate driver 4 sequentially supplies the gate pulses overlapped by the a half horizontal period or less to the adjacent gate lines from GL1 to GLn to turn on the TFT connected with the gate lines GL1 to GLn. Meanwhile, the gate driver 4 is formed at one side of the display area 2 when forming the TFT in the display area 2.

Figure 5:
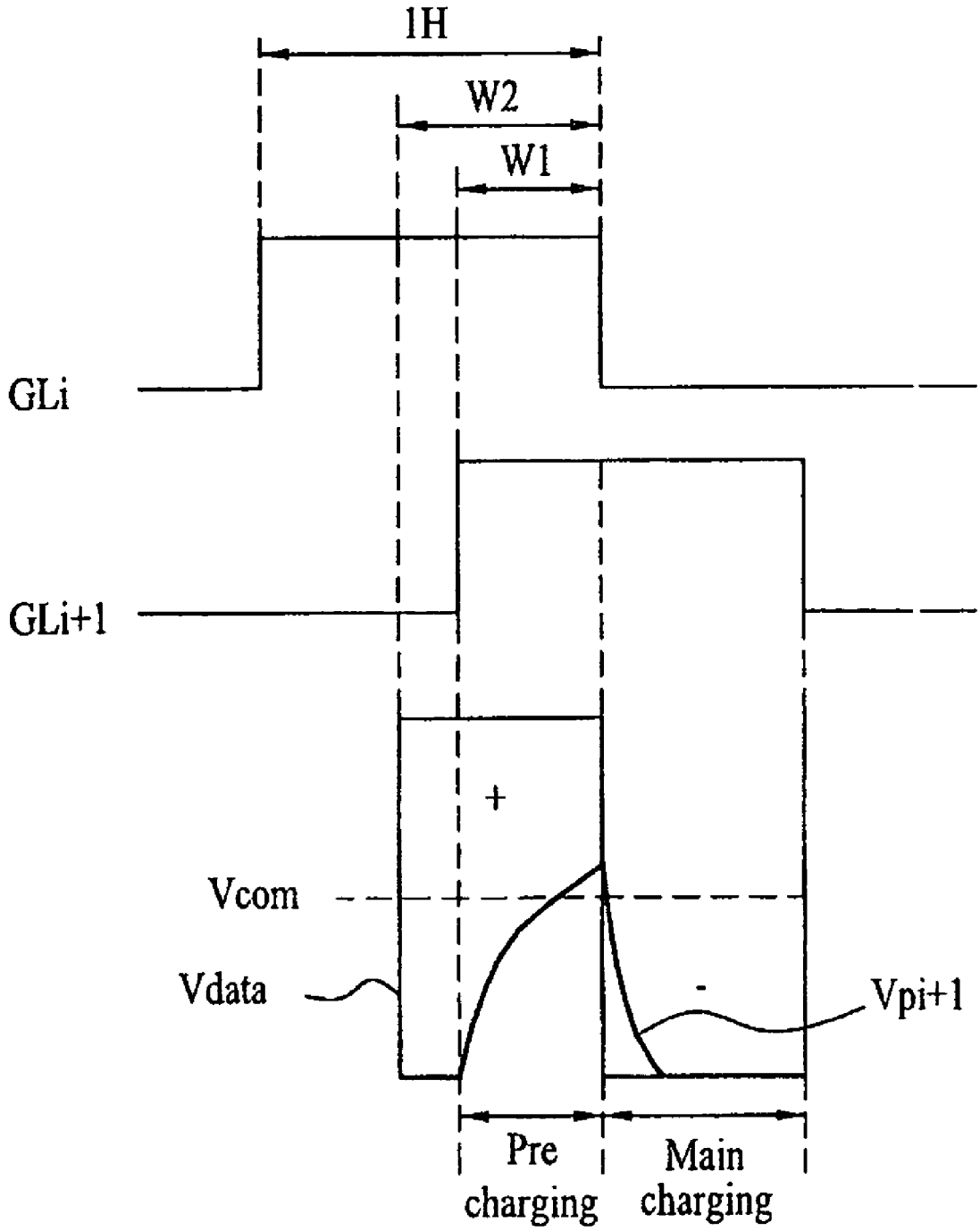
FIG. 5 shows exemplary waveforms illustrating the charging property of a pixel according to an embodiment of the present invention.

FIG. 5 shows exemplary waveforms illustrating the charging property of a pixel according to an embodiment of the present invention. Referring to FIG. 5, the gate pulses supplied to the adjacent i-numbered and (i+1)-numbered gate lines GLi and GLi+1 are overlapped by W2), for example a half horizontal period or less, to enhance the charging property (VPi+1) of pixel. The gate pulse supplied to the pixel connected to the (i+1)-numbered gate line GLi+1 is overlapped with the gate pulse supplied to the pixel connected to the i-numbered gate line GLi by W2. Accordingly, part of the positive (+) data voltage is pre-charged, and then the negative (−) data voltage is main-charged. Accordingly, it is possible to decrease the modulation width between the data voltages on the polarity inversion by decreasing the time for the pre-charging of pixel to enhance the charging property of pixel. In an embodiment, the pre-charging period is smaller than the main-charging period.

Thus, according to an embodiment of the present invention, the pre-charging method may be applied to a dot inversion mode or a line inversion mode as well as a column inversion mode.

Figure 6:
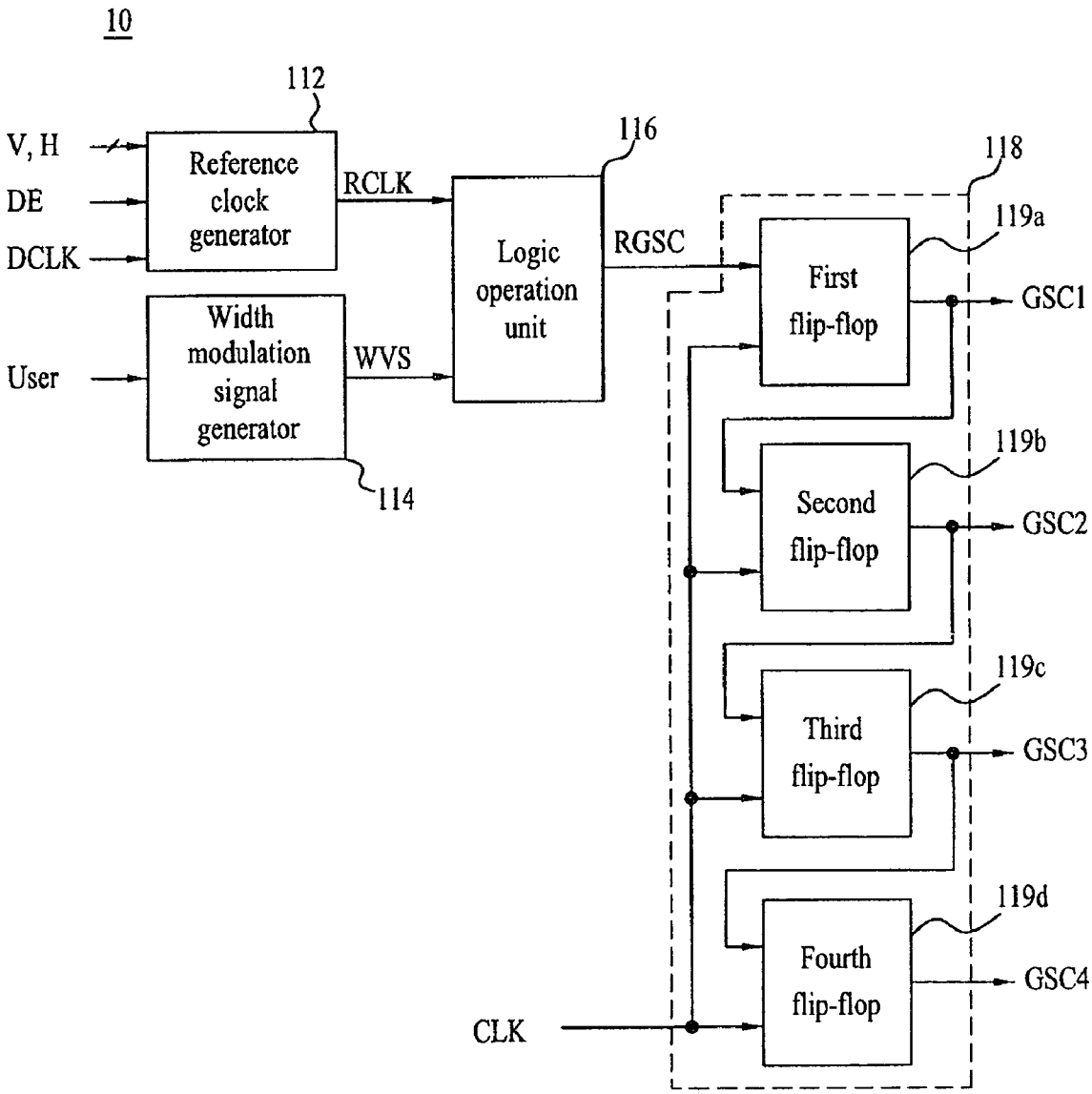
FIG. 6 shows a schematic diagram of a second exemplary clock signal generator according to an embodiment of the present invention.

FIG. 6 shows a schematic diagram of a second exemplary clock signal generator according to an embodiment of the present invention. Referring to FIG. 6 in association with FIG. 2, the clock signal generator includes a reference clock generator 112, a width modulation signal generator 114, a logic operation unit 116, and a gate shift clock generator 118. The reference clock generator 112 generates a reference clock RCLK corresponding to one horizontal period by using the vertically and horizontally synchronized signals V and H, the data enable signal DE, and the dot clock signal DCLK.

The width modulation signal generator 114 generates a width modulation signal WVS corresponding to an initial portion, for example, a rising time of a horizontal period. The width modulation signal WVS may have a fixed pulse width. Alternatively, the pulse width may be user-adjustable.

The logic operation unit 116 generates a reference gate shift clock RGSC by an XOR operation of the reference clock RCLK and the width modulation signal WVS. Accordingly, the reference gate shift clock RGSC has a pulse width obtained by subtracting a pulse width of the width modulation signal WVS from the half horizontal period W2.

The gate shift clock generator 118 generates first to fourth gate shift clocks GSC1 to GSC4 overlapped by a half horizontal period or less by sequentially shifting the reference gate shift clock RGSC according to a clock signal CLK. The gate shift clock generator 118 includes first to fourth flip-flops 119*a*, 119*b*, 119*c*, 119*d* for performing the sequential shifting operation.

The first flip-flop 119*a* outputs the reference gate shift clock RGSC provided from the logic operation unit 116 as the first gate shift clock GSC1 in accordance with the clock signal CLK. The second flip-flop 119*b* outputs the first gate shift clock GSC1 provided from the first flip-flop 119*a* as the second gate shift clock GSC2 in accordance with the clock signal CLK. The third flip-flop 119*c* outputs the second gate shift clock GSC2 provided from the second flip-flop 119*b* as the third gate shift clock (GSC3) in accordance with the clock signal CLK. The fourth flip-flop 119*d* outputs the third gate shift clock GSC3 provided from the third flip-flop 119*c* as the fourth gate shift clock GSC4 in accordance with the clock signal CLK.

Figure 7:
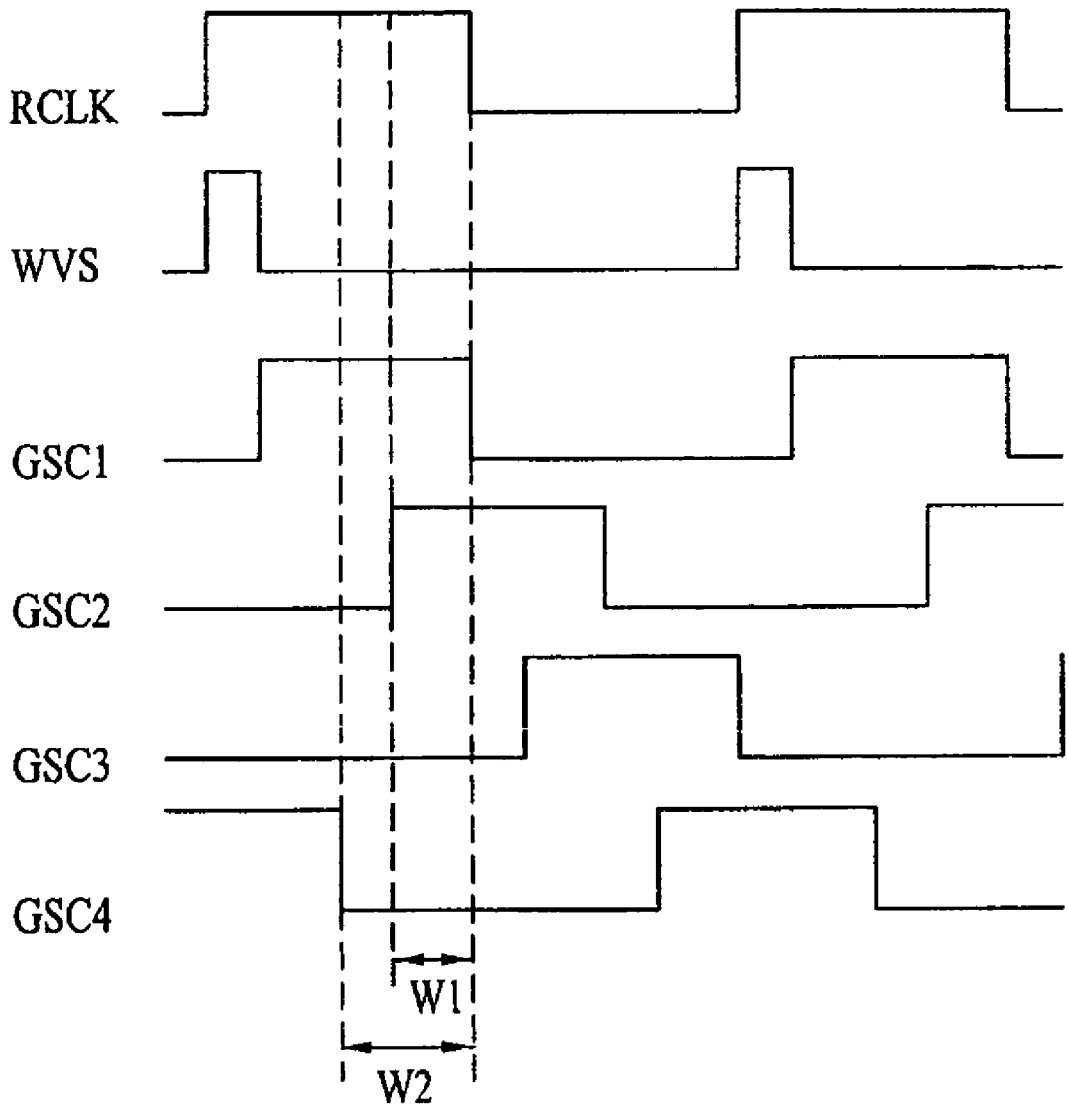
FIG. 7 shows exemplary waveforms for driving the clock signal generator of FIG. 6.

FIG. 7 shows exemplary waveforms for driving the clock signal generator of FIG. 6. Referring to FIG. 7, the clock signal generator 10 generates the reference gate shift clock RGSC having a width W1 which corresponds to W2, a half horizontal period or less, by the XOR operation of the reference clock RCLK having the width of one horizontal period and the modulation signal WVS. Also, the clock signal generator 10 generates the first to fourth gate shift clocks GSC1 to GSC4 overlapped by a half horizontal period or less by sequentially shifting the reference gate shift clock RGSC according to the clock signal CLK.

Accordingly, the overlapped portion W1 of the first to fourth gate shift clocks GSC1 to GSC4 is less than the half (W2) of one horizontal period. Also, the overlapped portion W1 of the first to fourth gate shift clocks GSC1 to GSC4 corresponds to the portion obtained by subtracting the pulse width of the width modulation signal WVS from W2, a half horizontal period. Based on the pulse width of the width modulation signal WVS, the overlapped portion W1 of the first to fourth gate shift clocks GSC1 to GSC4 is controlled to be less than the half horizontal period.

In an embodiment of the present invention, the clock signal generator 10 may have more than four flip-flops.

In accordance with an embodiment of the present invention, the gate pulse supplied to the adjacent gate lines of an LCD device is shifted to be overlapped by the half horizontal period to decrease the pre-charging time of a pixel, thereby enhancing the charging property thereof. Accordingly, the pre-charging time of the pixel by is shorter than the main-charging time thereof, so that it is possible to enhance the charging property of pixel in the dot inversion or line inversion mode.

It will be apparent to those skilled in the art that various modifications and variations can be made in the exemplary embodiments of the present invention. Thus, it is intended that embodiments of the present invention cover the modifications and variations of the embodiments described herein provided they come within the scope of the appended claims and their equivalents.

What is claimed is:

1. An apparatus for driving a liquid crystal display device comprising:

a display area which includes a plurality of liquid crystal cells in portions defined by a plurality of gate and data lines;

a gate driver which supplies overlapped gate pulses to the adjacent gate lines;

a data driver which supplies a data voltage to the data line in synchronization with the gate pulse; and a timing controller which controls an overlapped section of the gate pulses supplied to the adjacent gate lines using a plurality of gate shift clocks, wherein the overlapped section of the gate pulse supplied to the adjacent gate lines is less than the half width of each gate pulse when the polarities of the data voltages supplied to the adjacent liquid crystal cells corresponding to the adjacent gate lines are inversion, wherein the timing controller includes a clock signal generator which generates the plurality of gate shift clocks shifted in sequence and overlapped by less than the half of one horizontal period between the adjacent gate shift clocks, wherein the clock signal generator includes:

a reference clock generator which generates a plurality of reference clocks shifted in sequence and overlapped by the half of the one horizontal period between the adjacent reference clocks, wherein each of the plurality of reference clocks has the same pulse width as the one horizontal period;

a width modulation signal generator which generates a plurality of width modulation signals to control the overlapped section of the gate pulses, wherein each of the plurality of width modulation signals corresponds to each reference clock and overlaps a first period of the corresponding reference clock; and a logic operation unit which generates the plurality of gate shift clocks by a logic operation of the reference clock and the width modulation signal, wherein each of the plurality of gate shift clocks corresponds to each reference clock and overlaps a second period of the corresponding reference clock, wherein the second period is subtracting the first period from a pulse width of the corresponding reference clock.

2. The apparatus of claim 1, wherein the logic operation corresponds to an exclusive-OR.

3. The apparatus of claim 1, wherein the width modulation signal is generated in correspondence with an initial section of one horizontal period, the initial section less than the half of one horizontal period.

4. The apparatus of claim 3, wherein a pulse width of the width modulation signal is modulated in the initial section of one horizontal period based on the setting of a user.

5. An apparatus for driving a liquid crystal display device comprising:

a display area which includes a plurality of liquid crystal cells in portions defined by a plurality of gate and data lines;

a gate driver which supplies overlapped gate pulses to the adjacent gate lines;

a data driver which supplies a data voltage to the data line in synchronization with the gate pulse; and a timing controller which controls an overlapped section of the gate pulses supplied to the adjacent gate lines using a plurality of gate shift clocks, wherein the overlapped section of the gate pulse supplied to the adjacent gate lines is less than the half width of each gate pulse when the polarities of the data voltages supplied to the adjacent liquid crystal cells corresponding to the adjacent gate lines are inversion, wherein the timing controller includes a clock signal generator which generates the plurality of gate shift clocks shifted in sequence and overlapped by less than the half of one horizontal period between the adjacent gate shift clocks, wherein the clock signal generator includes:

a reference clock generator which generates a single reference clock having a pulse width corresponding to one horizontal period;

a width modulation signal generator which generates a single width modulation signal to control the overlapped section of the gate pulses, wherein the width modulation signal overlaps a first period of the reference clock;

a logic operation unit which generates a reference gate shift clock by a logic operation of the reference clock and the width modulation signal; and a gate shift clock generator which generates a plurality of gate shift clocks by shifting the reference gate shift clock, wherein each of the plurality of gate shift clocks has the same pulse width as a second period of the reference clock, wherein the second period is subtracting the first period from the pulse width of the reference clock.

6. The apparatus of claim 5, wherein the logic operation corresponds to an exclusive-OR.

7. The apparatus of claim 5, wherein the gate shift clock generator includes a plurality of flip-flops which shift the reference gate shift clock in accordance with a clock signal.

8. A method for driving an LCD device provided with a display area having a plurality of liquid crystal cells formed in portions defined by a plurality of gate and data lines comprising:

sequentially supplying gate pulses to the gate lines; and supplying a data voltage to the data line in synchronization with the gate pulse, wherein the gate pulses supplied to the adjacent gate lines are overlapped by less than the half of each gate pulse when the polarities of the data voltages supplied to the adjacent liquid crystal cells corresponding to the adjacent gate lines are inversion, wherein the process of sequentially supplying the gate pulses to the gate lines includes:

generating a plurality of reference clocks shifted in sequence and overlapped by less than the half of one horizontal period between the adjacent reference clocks, wherein each of the plurality of reference clocks has the same pulse width as the one horizontal period;

generating a plurality of width modulation signals to control the overlapped section of the gate pulses, wherein each of the plurality of width modulation signals corresponds to each reference clock and overlaps a first period of the corresponding reference clock;

generating a plurality of gate shift clocks by a logic operation of the reference clock and the width modulation signal, wherein each of the plurality of gate shift clocks corresponds to each reference clock and overlaps a second period of the corresponding reference clock, wherein the second period is subtracting the first period from a pulse width of the corresponding reference clock; and generating the gate pulses according to the plurality of gate shift clocks, and sequentially supplying the generated gate pulses to the gate lines.

9. The method of claim 8, wherein the logic operation corresponds to an exclusive-OR.

10. The method of claim 8, wherein the width modulation signal is generated in correspondence with an initial section of one horizontal period, the initial section less than the half of one horizontal period.

11. A method for driving an LCD device provided with a display area having a plurality of liquid crystal cells formed in portions defined by a plurality of gate and data lines comprising:

sequentially supplying gate pulses to the gate lines; and supplying a data voltage to the data line in synchronization with the gate pulse, wherein the gate pulses supplied to the adjacent gate lines are overlapped by less than the half of each gate pulse when the polarities of the data voltages supplied to the adjacent liquid crystal cells corresponding to the adjacent gate lines are inversion, wherein the process of sequentially supplying the gate pulses to the gate lines includes:

generating a single reference clock having a pulse width corresponding to one horizontal period;

generating a single width modulation signal to control the overlapped section of the gate pulses, wherein the width modulation signal overlaps a first period of the reference clock;

generating a reference gate shift clock by a logic operation of the reference clock and the width modulation signal;

generating a plurality of gate shift clocks by shifting the reference gate shift clock, wherein each of the plurality of gate shift clocks has the same pulse width as a second period of the reference clock, wherein the second period is subtracting the first period from the pulse width of the reference clock; and generating the gate pulses according to the plurality of gate shift clocks, and sequentially supplying the gate pulses to the gate lines.

12. The method of claim 11, wherein the logic operation corresponds to an exclusive-OR.

13. The method of claim 11, wherein the process of generating the plurality of gate shift clocks uses a plurality of flip-flops to generate the gate shift clocks by shifting the reference gate shift clock according to the clock signal.

* * * * *